United States Patent [19]

Hatakenaka

[11] Patent Number: 4,637,367

[45] Date of Patent: Jan. 20, 1987

[54] CRANKCASE EMISSION CONTROL SYSTEM FOR AN INTERNAL COMBUSTION ENGINE

[75] Inventor: Masato Hatakenaka, Yokohama, Japan

[73] Assignee: Nissan Motor Company, Limited, Japan

[21] Appl. No.: 709,379

[22] Filed: Mar. 7, 1985

[30] Foreign Application Priority Data

Mar. 14, 1985 [JP] Japan ..... 59-37183[U]

[51] Int. Cl.[4] ..... F01M 13/00

[52] U.S. Cl. ..... 123/572

[58] Field of Search ..... 123/572, 573, 574, 41.86

[56] References Cited

U.S. PATENT DOCUMENTS

| | | | |
|---|---|---|---|
| 3,908,617 | 9/1975 | Partridge | 123/572 |
| 3,949,719 | 4/1976 | Bellanca et al. | 123/572 |
| 4,269,607 | 5/1981 | Walker | 123/573 |
| 4,459,966 | 7/1984 | Sakano et al. | 123/573 |
| 4,497,289 | 2/1985 | Bortolussi | 123/90.27 |
| 4,528,969 | 7/1985 | Senga | 123/573 |

OTHER PUBLICATIONS

Toyota Corolla New Model Manual, pp. 7–77, (May 1983).

*Primary Examiner*—William A. Cuchlinski, Jr.
*Attorney, Agent, or Firm*—Leydig, Voit & Mayer

[57] ABSTRACT

First and second cam covers define at least parts of first and second cam chambers respectively. Blow-by gas produced in an internal combustion engine is conducted to the first and second cam chambers. A communication passage connects the first and second cam chambers. A gas passage connects the communication passage and an air intake passage of the engine. A device disposed essentially at the connection between the communication passage and the gas passage serves to keep oil out of blow-by gas being drawn back into the air intake system of the engine.

5 Claims, 4 Drawing Figures

CRANKCASE EMISSION CONTROL SYSTEM FOR AN INTERNAL COMBUSTION ENGINE

BACKGROUND OF THE INVENTION

1. Field of the Invention

This invention relates to a crankcase emission control system or a crankcase ventilation system for an internal combustion engine.

2. Description of the Prior Art

In internal combustion engine, compressed air-fuel mixture and combustion products leak from combustion chambers into crankcase past piston rings. This leakage is called "blow-by gas". Since blow-by gases contain harmful components, it is necessary to prevent them from venting to the atmosphere.

A crankcase emission control system or a crankcase ventilation system returns blow-by gases back to combustion chambers in order to prevent their emission into the atmosphere.

TOYOTA COROLLA NEW MODEL MANUAL, on pages 7–77, issued by Toyota Jidōsha Kōgyō Kabushiki Kaisha on May 1983, discloses a crankcase ventilation system for a double-overhead camshaft (DOHC) engine having a pair of cam covers for inlet and outlet valve cam arrangements.

In this TOYOTA system, blow-by gas moves up from the crankcase into the cam covers and then travels to an intake manifold through a pipe. Only one of the two cam covers has an opening for venting the blow-by gas into the pipe, so that the covers differ from one another in shape. Therefore, it is necessary to use two different processes to manufacture the two cam covers. In addition, two cam chambers within the cam covers have different ventilation characteristics. Specifically, the ventilation characteristics of the cam chamber romote from the vent opening tend to be impaired.

SUMMARY OF THE INVENTION

It is an object of this invention to provide a crankcase emission control system for a DOHC engine which allows a reduction in the number of manufacturing processes in comparison with the TOYOTA system.

It is another object of this invention to provide a crankcase emission control system for a DOHC engine which affords the two cam chambers acceptably comparable ventilation characteristics.

In accordance with this invention, first and second cam covers define at least part of first and second cam chambers respectively. Blow-by gas produced in an internal combustion engine is conducted to the first and second cam chambers. A communication passage connects the first and second cam chambers. A gas passage connects the communication passage and an air intake passage of the engine. A device disposed essentially at the connection between the communication passage and the gas passage serves to trap oil.

DESCRIPTION OF THE PREFERRED EMBODIMENT

Figure 1:
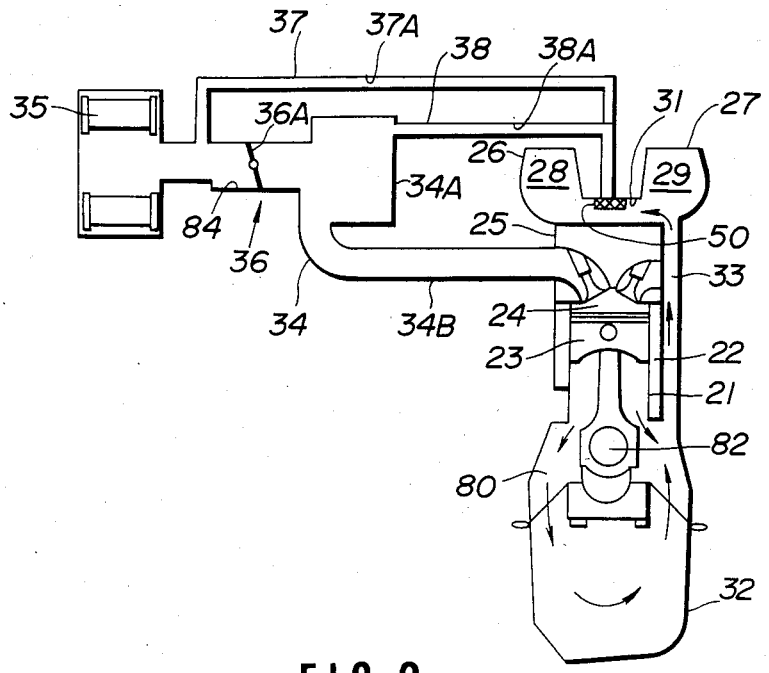
FIG. 1 is a diagram of an internal combustion engine including a crankcase emission control system according to an embodiment of this invention.

With reference to FIG. 1, a four-cylinder in-line DOHC engine includes a cylinder block 21 having four cylinders 22, one of which is shown. Pistons 23 tightly but slidably disposed within the cylinders 22 define combustion chambers 24 in conjunction with a cylinder head 25 fixed to the top of the cylinder block 21.

Figure 2:
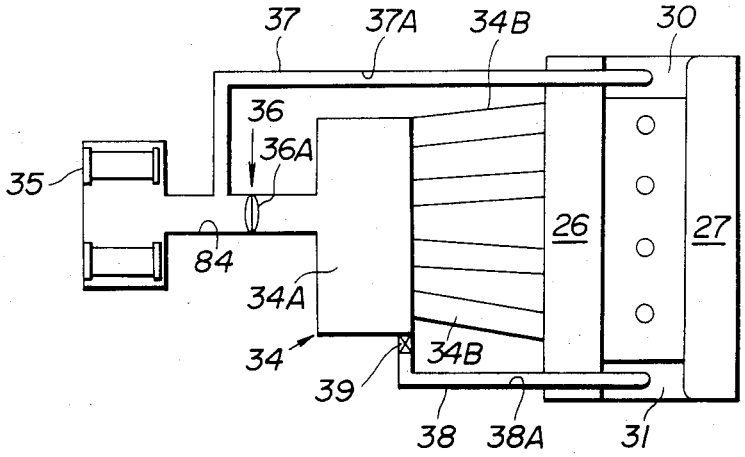
FIG. 2 is a diagrammatical top view of the engine of FIG. 1.

As shown in FIGS. 1 and 2, a pair of mirror-symmetrically arranged cam covers 26 and 27 having the same shape are mounted atop the cylinder head 25. As best shown in FIG. 1, the first cam cover 26 and the cylinder head 25 define a cam chamber 28 accommodating an inlet valve cam arrangement (not shown). The second cam cover 27 and the cylinder head 25 define another cam chamber 29 accommodating an outlet valve cam arrangement (not shown). These cam chambers 28 and 29 are juxtaposed with respect to each other and oppose each other along the line of cylinders 22. A first pair of adjacent or opposing ends of the cam chambers 28 and 29 communicate with one another via a passage 30 extending therebetween. Specifically, the communication passage 30 runs perpendicular to the line of cylinders 22. A second pair of adjacent or opposing ends of the cam chambers 28 and 29 communicate with one another via a passage 31 extending therebetween. Specifically, the communication passage 31 runs perpendicular to the line of the cylinders 24.

Figure 3:
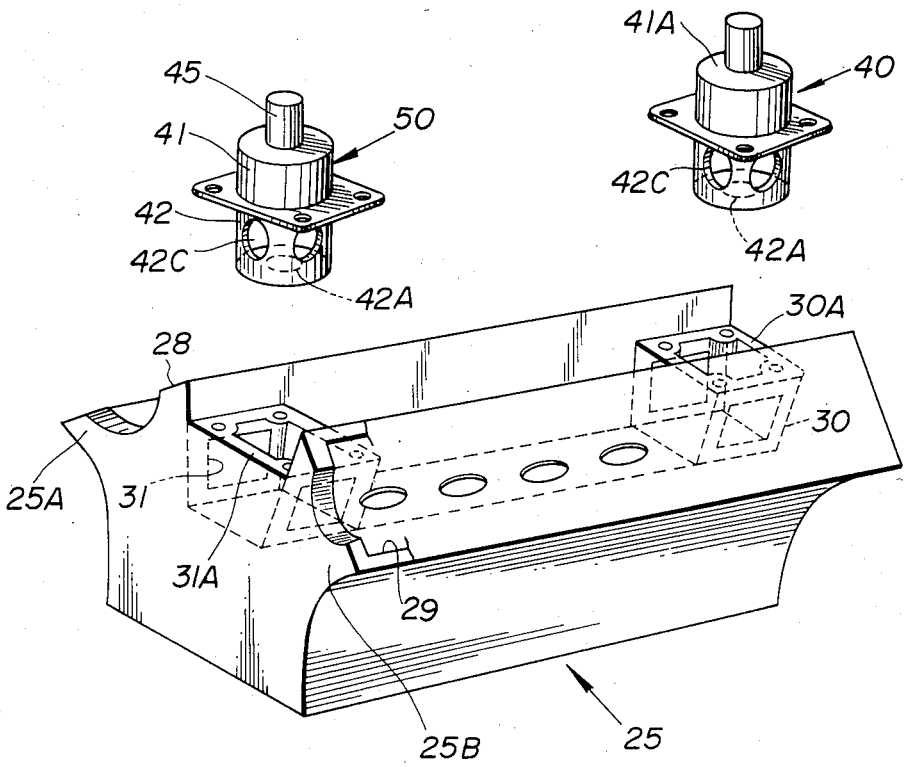
FIG. 3 is a partially-exploded perspective view of the oil eliminators and the cylinder head of FIG. 1.

As best shown in FIG. 3, the cylinder head 25 has an approximately Y-shaped cross-section and includes a pair of parallel banks 25A and 25B. The cam covers 26 and 27 (see FIGS. 1 and 2) attached to the tops of these banks 25A and 25B define the cam chambers 28 and 29 in conjunction with the banks 25A and 25B. A rectangular duct 30A extending between the banks 25A and 25B at one end of the engine forms the communication passage 30. The walls of the tube 30A are integral with the walls of the banks 25A and 25B. Another rectangular duct 31A extending between the banks 25A and 25B at the other end of the engine serves as the other communication passage 31. Similarly, the walls of the tube 31A are integral with the walls of the banks 25A and 25B.

An oil pan 32 is fixed to the bottom of the cylinder block 21. The oil pan 32 and the cylinder block 21 define a crank chamber 80 accommodating a crankshaft 82 connected to the pistons 23. The lower part of the crank chamber 80 defined within the oil pan 32 contains oil for lubricating the pistons 23, inlet and outlet valve drive trains (not shown), and other moving parts.

A section of the cylinder block 21 on one side of the line of cylinders 22 defines a blow-by passage 33 extending vertically with respect to the cylinder block 21. A lower end of the blow-by passage 33 opens into the crank chamber 80. An upper end of the blow-by passage 33 opens into the outlet valve cam chamber 29. In this way, the outlet valve cam chamber 29 communicates with the crank chamber 80 via the blow-by passage 33. The inlet valve cam chamber 28 communicates with the crank chamber 80 via the blow-by passage 33, the inlet valve cam chamber 29, and the communication passages 30 and 31.

An intake manifold 34 includes a common inlet section 34A and four intake ducts 34B extending from the common inlet section 34A to one side of the cylinder head 25. The intake ducts 34B communicate with the common inlet section 34A and also with intake ports defined in the cylinder head 25 and leading to the combustion chambers 24. A tube or barrel 36 extending between the common inlet 34A and an air cleaner 35 defines a chamber accommodating a throttle valve 36A. One end of the barrel 36 opens into the atmosphere via the air cleaner 35. The other end of the barrel 36 leads to the combustion chambers 24 via the modifold common inlet section 34A, and the intake ducts 34B. The barrel 36 and the manifold common inlet section 34A form part of an air intake passage 84 connecting the combustion chambers 24 to the atmosphere. The throttle valve 36A is disposed in this air intake passage 84.

A pipe 37 defines a passage 37A. One end of the passage 37A is connected to a point of the air intake passage 84 upstream of the throttle valve 36A. The other end of the passage 37A is connected to the center of the communication passage 30. In this way, a segment of the air intake passage 84 upstream of the throttle valve 36A communicates with the communication passage 30 via the passage 37A.

A blow-by return pipe 38 defines a passage 38A. One end of the blow-by return passage 38A is connected to the interior of the manifold common inlet section 34A. The other end of the blow-by return passage 38A is connected to the center of the communication passage 31. In this way, a segment of the air intake passage 84 downstream of the throttle valve 36A communicates with the communication passage 31 via the blow-by return passage 38A.

A positive crankcase ventilation (PCV) or emission control valve 39 disposed in a segment of the blow-by return passage 38A adjacent the manifold common inlet section 34A adjusts the effective cross-sectional area of the passage 38A as a function of vacuum developed in the air intake passage 84 downstream of the throttle valve 36A. It should be noted that this vacuum represents the load on the engine.

Figure 4:
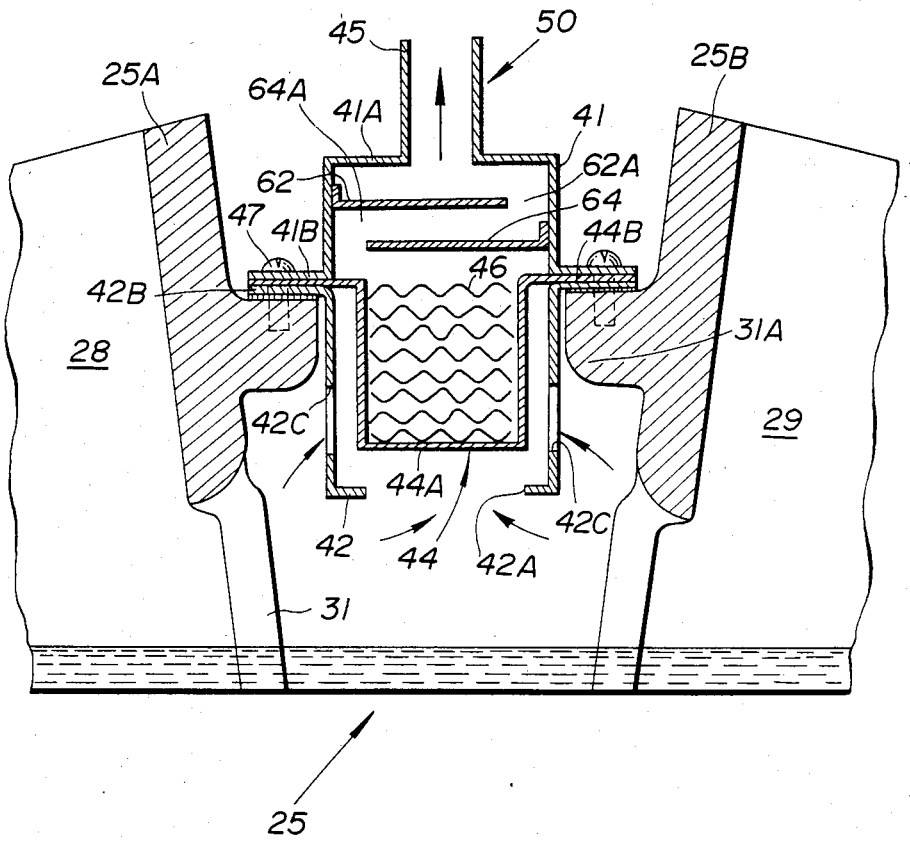
FIG. 4 is a longitudinal section view of the oil eliminator of FIG. 3 and its surroundings.

As shown in FIGS. 1, 3, and 4, an oil separation device or oil eliminator 40 is disposed in the connection between the communication passage 30 and the blow-by return passage 37A. Another oil separation device or oil eliminator 50 is disposed in the connection between the communication passage 31 and the passage 38A. Specifically, the rectangular ducts 30A and 31A have top openings accommodating the oil eliminators 40 and 50. These oil eliminators 40 and 50 are of the same design.

As shown in FIGS. 3 and 4, the oil eliminator 50 includes a cup-shaped upper cover 41 and a tubular lower cover 42, the covers 41 and 42 being coaxially aligned and having the same diameter. These covers 41 and 42 form the casing of the oil eliminator 50. The cup-shaped cover 41 has a closed upper end and an open lower end. The upper end of the cover 41 is closed by an end wall 41A. An outlet tube 45 integral with the end wall 41A extends coaxially from the center of the end wall 41A. The outlet tube 45 communicates with the cylindrical interior of the oil eliminator 50 defined by the covers 41 and 42. The end of the blow-by return pipe 38 is connected to the outlet tube 45. The lower end of the cup-shaped cover 41 is formed with an outwardly-extending flange 41B opposing a corresponding flange 42B formed on the upper end of the other cover 42. These flanges 41B and 42B are fixed by means of bolts 47 to shoulders defined by the top walls of the rectangular duct 31A which are integral with the walls of the cylinder head banks 25A and 25B. The lower end of the cover 42 has an inlet opening 42A. Cylindrical walls of the cover 42 has inlet openings 42C.

A cup-shaped member 44 disposed coaxially within the interior of the oil eliminator 50 has an open upper end and a porous bottom wall 44A. The upper end of the member 44 is formed with an outwardly-extending flange 44B fixedly sandwiched between the flanges 41B and 42B of the covers 41 and 42. One or more sheets of wire cloth or wire gauze 46 serving as screens are disposed in the cup-shaped member 44. It should be noted that the entire wall surface of the cup-shaped member 44 may be porous.

A set of baffle plates 62 and 64 fixed to the upper cover 41 are disposed within the oil eliminator 50 above the cup-shaped member 44. The baffle plates 62 and 64 are preferably discs of essentially the same diameter as the cup-shaped member 44 minus small chords cut away to leave gaps 62A and 64A. The baffle plates 62 and 64 are spaced axially and extend perpendicular to the axis of the oil eliminator 50. The gaps 62A and 64A lie on diametrically opposite sides of the oil eliminator 50. Thus, the fluid flow path through the oil eliminator 50 is not directly vertical, but rather passes horizontally between the baffle plates 62 and 64 across their entire diameter. It should be noted that this fluid flow path includes gaps 62A and 64A. The baffle plates 62 and 64 may be of other shapes.

In operation, blow-by gas having leaked into the crank chamber 80 flows upwards to the cam chambers 28 and 29 through the blow-by passage 33.

In cases where the engine is operating under a small load, fresh air having passed the air cleaner 35 flows into the cam chambers 28 and 29 via the passage 37A, the oil eliminator 40, and the communication passage 30. This fresh air mixes with the blow-by gas in the cam chambers 28 and 29. The mixture of fresh air and blow-by gas moves into the communication passage 31 before entering the blow-by return passage 38A via the oil eliminator 50. The mixture of fresh air and blow-by gas flows from the blow-by return passage 38A into the manifold common inlet section 34A via the PCV valve 39 and is then drawn into the combustion chambers 24 via the intake manifold 34. The PCV valve 39 determines the rate of flow of the fresh air/ blow-by gas mixture which depends on the vacuum in the air intake passage 84 downstream of the throttle valve 36A.

In cases where the engine is operating under a heavy load, the blow-by gas moves from the cam chambers 28 and 29 into the communication passages 30 and 31 before entering the passages 37A and 38A via the oil eliminators 40 and 50. The blow-by gas flows from the passage 37A into the air intake passage 84 upstream of the throttle valve 36A and is then drawn into the combustion chambers 24 via the intake manifold 34. The blow-by gas flows from the blow-by return passage 38A into the manifold common inlet section 34A via the PCV valve 39 and is then drawn into the combustion chambers 24.

A small amount of lubricant oil is entrained by the blow-by gas and transported from the crank chamber 80 to the cam chambers 28 and 29. In the cam chambers 28 and 29, the blow-by gas or the mixture of blow-by gas and fresh air is exposed to a spray of lubricant oil off the inlet and outlet valve drive trains. The oil eliminators 40 and 50 remove this lubricant oil from the blow-by gas or the mixture of blow-by gas and fresh air in order to keep the lubricant oil out of the passages 37A and 38A, and the combustion chambers 24.

Both oil eliminators 40 and 50 operate in the same way. The blow-by gas or the mixture of blow-by gas and fresh air by which the lubricant oil is entrained enters the oil eliminator 50 from the communication passage 31 via the inlet openings 42A and 42C. The gaseous components easily pass through the porous bottom wall 44A of the member 44 and the wire screens 46. However, most of the lubricant oil is trapped by and deposited on the porous bottom wall 44A and the wire screens 46. Finally, the blow-by gas or the mixture of blow-by gas and fresh air moves through the space between the baffle plates 62 and 64 via the gap 62A and 64A. As the gases pass through this space, any remaining lubricant oil having passed the porous bottom wall 44A and the wire screens 46 precipitates onto the baffle plates 62 and 64. The trapped and deposited lubricant oil drops along the cylinder head 25 and then returns to the oil pan 32 via oil passages (not shown).

Since the cam covers 26 and 27 have the same shape, the number of processes required for their manufacture can be reduced in comparison with the TOYOTA system.

The communication passages 30 and 31 are arranged symmetrically with respect to the cam chambers 28 and 29. Also, the junctions between the communication passage 30 and the passage 37A and between the communication passage 31 and the pasage 38A are disposed symmetrically between the cam chambers 28 and 29. These symmetry relations ensure that the cam chambers 28 and 29 will have the same ventilation characteristics.

The provision of the communication passages 30 and 31 prevents lubricant oil spray from being ejected out of the cam chambers 28 and 29 directly into the oil eliminators 40 and 50. This helps keep the lubricant oil out of the passages 37A and 38A.

The pipes 37 and 38 may extend along the sides of the cam covers 26 and 27 while remaining below the top of the cam covers 26 and 27. In this case, the total height of the engine can be reduced.

What is claimed is:

1. A crankcase emission control system for an internal combustion engine having an air intake passage and a throttle valve disposed in the air intake passage, the system comprising:

(a) a first cam cover defining at least part of a first cam chamber;

(b) a second cam cover defining at least part of a second cam chamber juxtaposed with respect to the first cam chamber;

(c) means for conducting blow-by gas to the first and second cam chambers;

(d) a first communication passage connecting a first pair of opposing ends of the first and second cam chambers;

(e) a second communication passage connecting a second pair of opposing ends of the first and second cam chambers;

(f) a first gas passage connecting the first communication passage and a point of the air intake passage upstream of the throttle valve;

(g) a second gas passage connecting the second communication passage and a point of the air intake passage downstream of the throttle valve;

(h) means disposed essentially at the connection between the first gas passage and the first communication passage for trapping oil; and (i) means disposed essentially at the connection between the second gas passage and the second communication passage for trapping oil.

2. The system of claim 1, wherein at least one of the two oil trapping means comprises a casing and a wire screen disposed within the casing.

3. The system of claim 1, wherein at least one of the two oil trapping means comprises a casing, a wire screen disposed within the casing, and a cupshaped member attached to and disposed within the casing, the cup-shaped member having a porous wall, the wire screen being received in the cup-shaped member.

4. The system of claim 1, wherein at least one of the two oil trapping means comprises a casing and a baffle disposed within and attached to the casing.

5. The system of claim 1, wherein the first and second cam covers have essentially the same shape.

* * * * *